US012214246B2

(12) United States Patent
Ruse

(10) Patent No.: US 12,214,246 B2
(45) Date of Patent: Feb. 4, 2025

(54) YOGA MAT WITH ADDITIONAL FEATURES

(71) Applicant: YOGI Fitness, Wayne, PA (US)

(72) Inventor: Joanne Ruse, Wayne, PA (US)

(73) Assignee: YOGI FITNESS, Wayne, PA (US)

( * ) Notice: Subject to any disclaimer, the term of this patent is extended or adjusted under 35 U.S.C. 154(b) by 128 days.

(21) Appl. No.: 17/815,350

(22) Filed: Jul. 27, 2022

(65) Prior Publication Data

US 2024/0033561 A1 Feb. 1, 2024
US 2024/0416171 A9 Dec. 19, 2024

Related U.S. Application Data

(63) Continuation-in-part of application No. 16/689,130, filed on Nov. 20, 2019, now abandoned, which is a continuation-in-part of application No. 15/947,851, filed on Apr. 8, 2018, now Pat. No. 10,946,235.

(60) Provisional application No. 62/769,592, filed on Nov. 20, 2018, provisional application No. 62/482,848, filed on Apr. 7, 2017.

(51) Int. Cl.
*A63B 21/00* (2006.01)

(52) U.S. Cl.
CPC .... *A63B 21/4037* (2015.10); *A63B 2225/682* (2013.01)

(58) Field of Classification Search
CPC ..... A47G 27/02; A47G 27/0212; A47G 27/0237; A47G 9/08; A47G 9/086; A47G 9/06; A47G 9/062; A63B 71/0036; A63B 21/4037; A63B 2209/10
See application file for complete search history.

(56) References Cited

U.S. PATENT DOCUMENTS 4,329,747 A * 5/1982 Russell ..... A47G 9/062 5/924
5,404,600 A * 4/1995 DeMars ..... A47G 9/086 5/413 R
6,092,574 A * 7/2000 Krulik ..... A45C 13/30 224/616
6,212,711 B1 * 4/2001 Gilmour ..... A47G 27/0212 383/4
6,640,359 B1 11/2003 Alane
6,663,537 B2 * 12/2003 McCoy ..... A63B 6/00 482/148
6,751,816 B1 * 6/2004 Wechsler ..... A47G 9/062 383/4
6,802,092 B1 * 10/2004 Klein ..... A47G 9/062 5/419
9,015,881 B2 4/2015 Kress
10,213,952 B2 2/2019 Shoham
(Continued)

OTHER PUBLICATIONS

Non Final Office Action received for U.S. Appl. No. 15/947,851, mailed on Mar. 13, 2020, 19 pages.
(Continued)

*Primary Examiner* — David R Hare
*Assistant Examiner* — Amanda L Bailey
(74) *Attorney, Agent, or Firm* — Schott, P.C.

(57) ABSTRACT

An accessorized yoga mat includes at least a mat including at least two configurations, a rolled configuration, and an unrolled configuration; a closure mechanism that secures the mat in the rolled configuration; and a carrying strap removably engaged to the mat and capable of supporting the mat during transport.

12 Claims, 18 Drawing Sheets

(56) References Cited

U.S. PATENT DOCUMENTS

| | | | | |
|---|---|---|---|---|
| 10,946,235 | B2 | 3/2021 | Ruse | |
| 2004/0088788 | A1 | 5/2004 | Alane | |
| 2007/0295773 | A1* | 12/2007 | Wegenhoft | A47G 9/062 224/576 |
| 2012/0227181 | A1* | 9/2012 | Cintas | A47G 27/0237 112/475.08 |
| 2015/0143632 | A1 | 5/2015 | Obrentz | |
| 2016/0332023 | A1 | 11/2016 | Taylor et al. | |
| 2017/0080278 | A1* | 3/2017 | Wiggins | A47K 10/02 |
| 2017/0307004 | A1 | 10/2017 | Cardella | |
| 2018/0257832 | A1* | 9/2018 | Loeffler | A45C 3/00 |
| 2018/0353801 | A1* | 12/2018 | Ruse | A47K 10/02 |
| 2020/0179746 | A1 | 6/2020 | Ruse | |
| 2022/0378233 | A1* | 12/2022 | Kelly | A47G 9/06 |

OTHER PUBLICATIONS

Notice of Allowance received for U.S. Appl. No. 15/947,851, mailed on Oct. 28, 2020, 10 pages.
Non Final Office Action received for U.S. Appl. No. 16/689,130, mailed on Jan. 29, 2021, 11 pages.
Final Office Action received for U.S. Appl. No. 16/689,130, mailed on Oct. 29, 2021, 12 pages.
Non Final Office Action received for U.S. Appl. No. 16/689,130, mailed on Feb. 28, 2022, 14 pages.

* cited by examiner

YOGA MAT WITH ADDITIONAL FEATURES

BACKGROUND

Yoga mats are flexible mats that can be rolled out during an exercise class to give a user comfort and protection from slipping. A yoga mat is generally a strip of material in a rectangular shape working to provide traction and a clean exercise space for the user. They are typically designed in a portable fashion allowing the user to easily transport the mat to and from exercise classes.

Such yoga mats are widely used yet often lack additional features needed to carry personal items, promote cleanliness, and enable easier carrying. If a user wishes to bring equipment to the exercise class, such as a water bottle or money, they must carry it separately from their mat. While the mat works to ensure a clean exercise space, it doesn't improve personal hygiene for the user. Thus, there remains a considerable need for a yoga mat with additional features for cleanliness. Finally, carrying such a mat is mostly either done in a bag or simple handle.

U.S. Pat. No. 9,015,881 to Kress shows one approach to the cleanliness challenge. In Kress, a yoga mat includes a rubber mat with an attached bamboo grid overlay. In between, a towel engages the mat, allowing for traction on the bamboo grid wile the towel captures the yogi's perspiration. This is an interesting approach but it does not solve some of the carrying challenges and its nearly full-length towel overlooks many yogi's desire to be in contact with the mat as much as practicable and not a towel or grid.

U.S. Pat. No. 6,640,539 to Mane shows a handle attached to a yoga mat. The handle attaches at the center of the mat and can be used as a shoulder strap. Alane's handle is not removable, however, and thus it can be in a yogi's way during practice. Further, its placement at the center of the mat does not allow for other ways of carrying the mat such as diagonally across a chest or with more room for maneuver over a shoulder.

SUMMARY OF THE EMBODIMENTS

An accessorized yoga mat includes at least a mat including at least two configurations, a rolled configuration, and an unrolled configuration; a closure mechanism that secures the mat in the rolled configuration; and a carrying strap removably engaged to the mat and capable of supporting the mat during transport.

The mat will be described in more detail below.

DETAILED DESCRIPTION OF THE EMBODIMENTS

FIGS. 1-11 show the yoga mat with accessories 100 described herein, with different of the views showing close ups of certain features.

Figure 1:
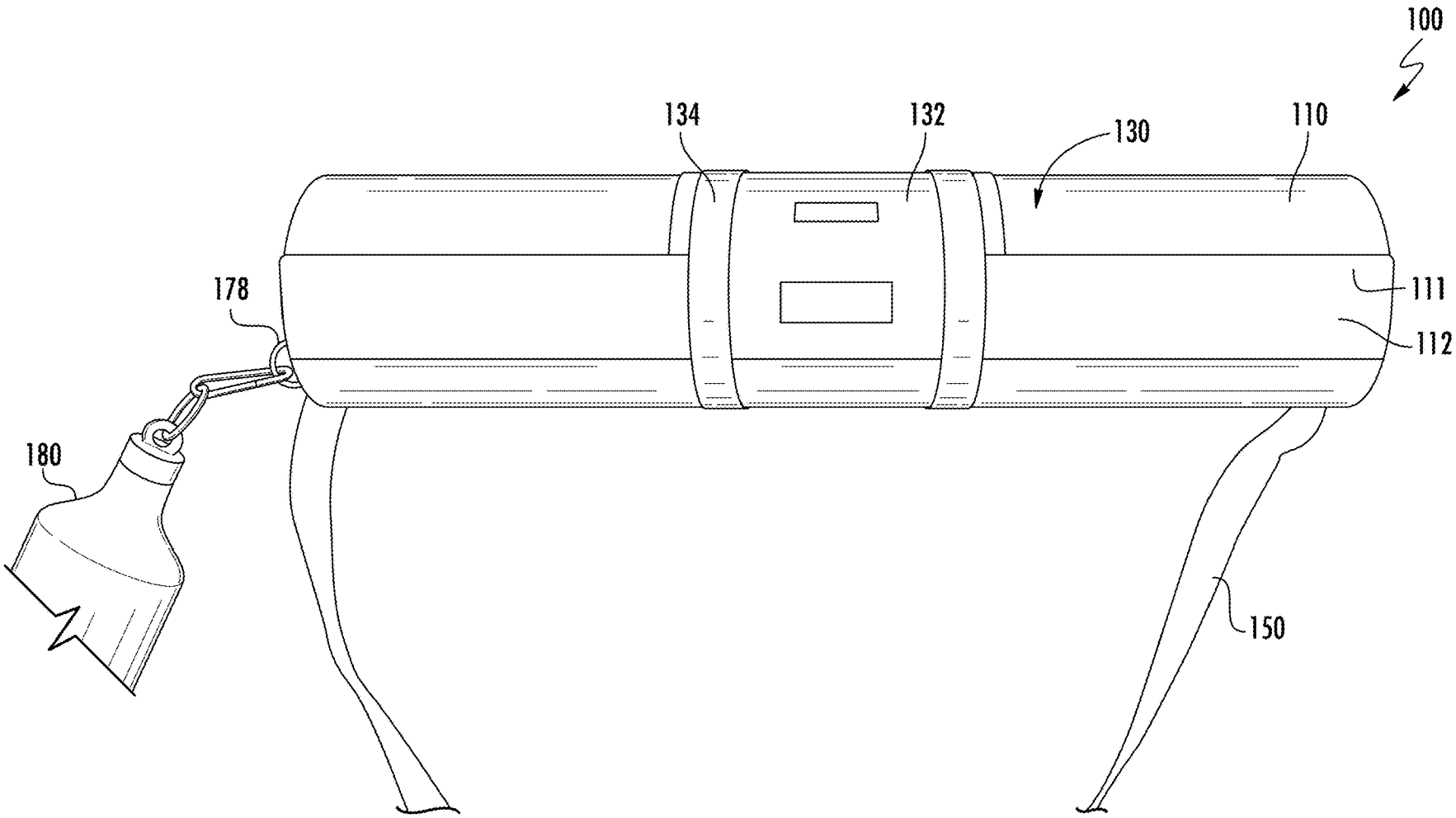
FIG. 1 is a perspective view of the mat with accessories.

FIG. 1 shows an accessorized yoga mat 100 comprising a mat 110 including at least two configurations, a rolled configuration, and an unrolled configuration. In the unrolled configuration, the yoga mat is in its traditional rectangular flat form, and in the rolled configuration, one short edge of the yoga mat 110 will be curled under and rolled until the mat 110 is in a substantially cylindrical shape that is suitable for transport.

Figure 11:
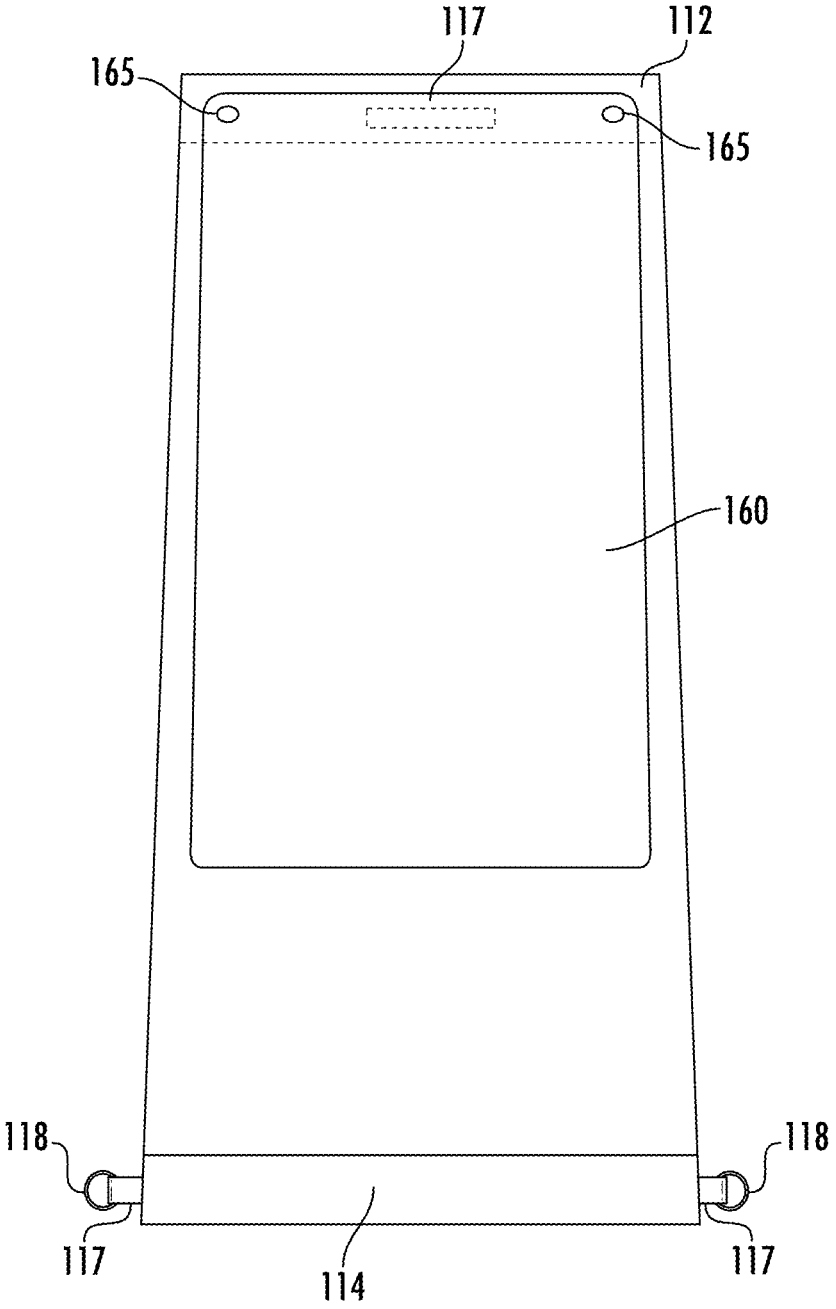
FIG. 11 shows the yoga mat in the unrolled configuration.
Figure 12:
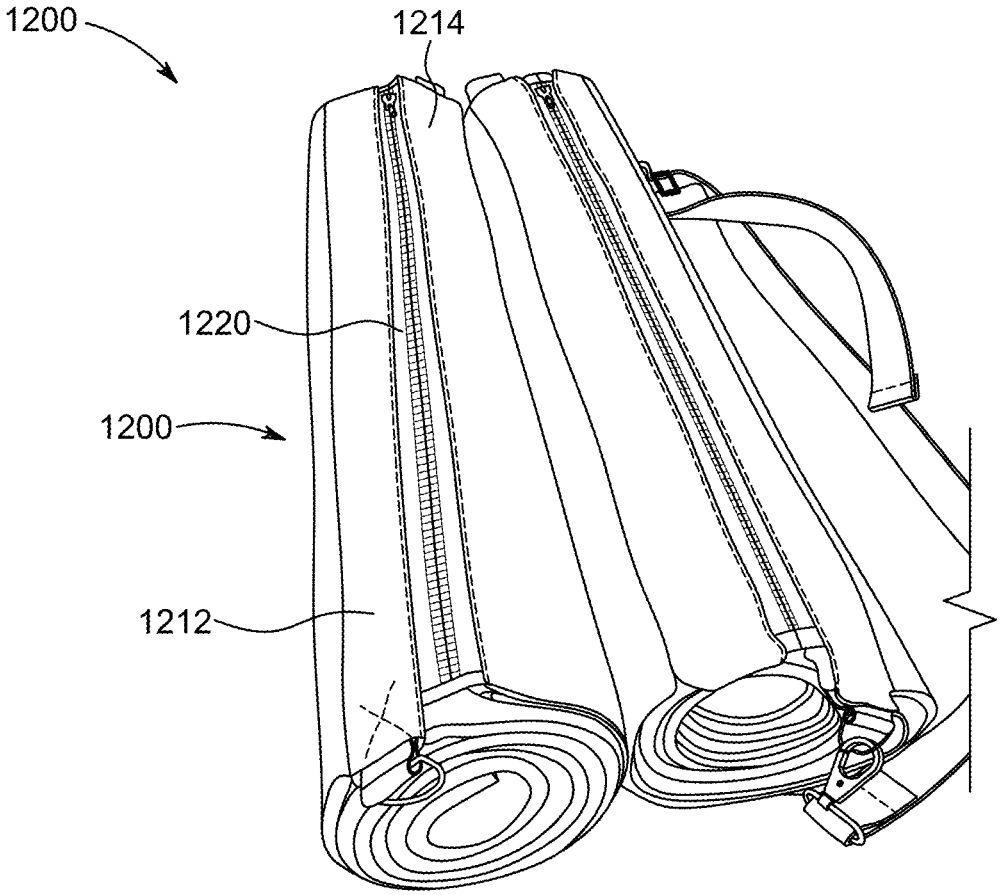
FIGS. 12-17 show another embodiment of the mat.
Figure 13:
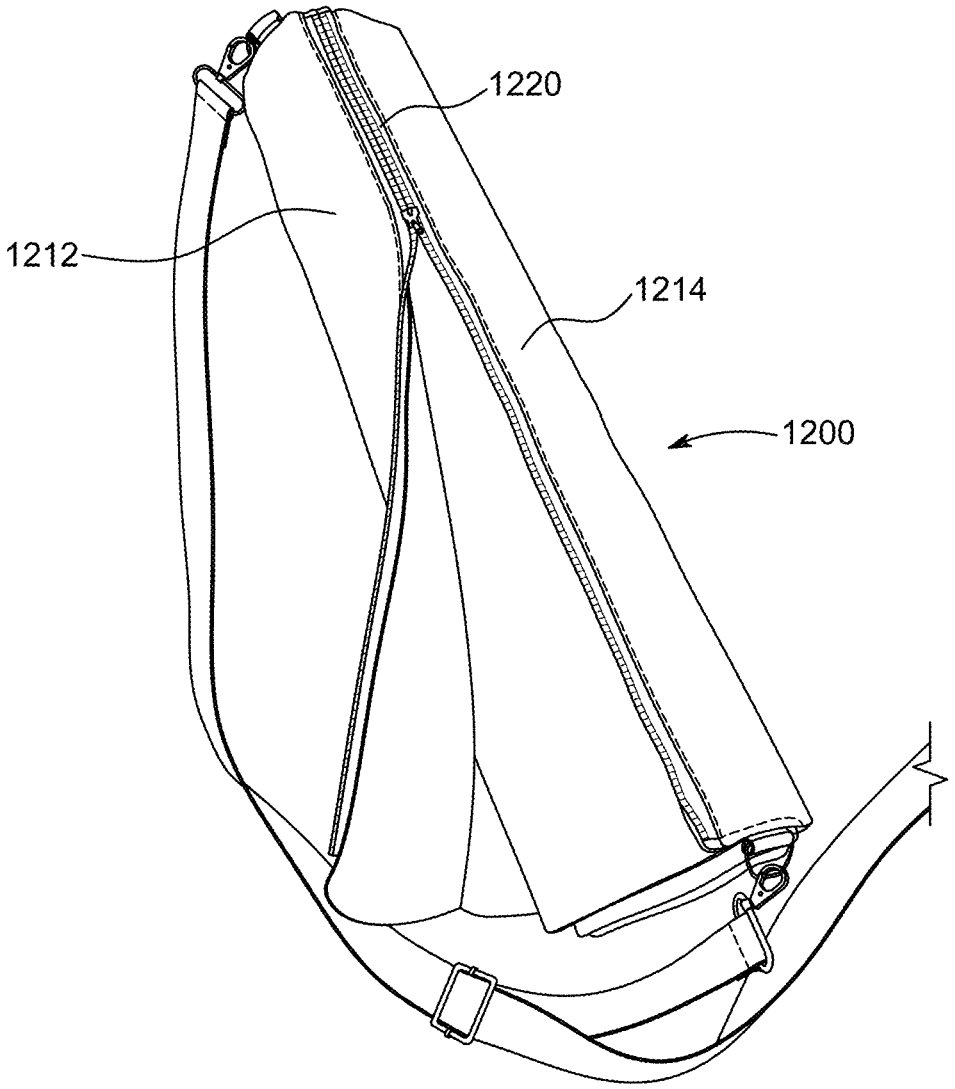
Figure 14:
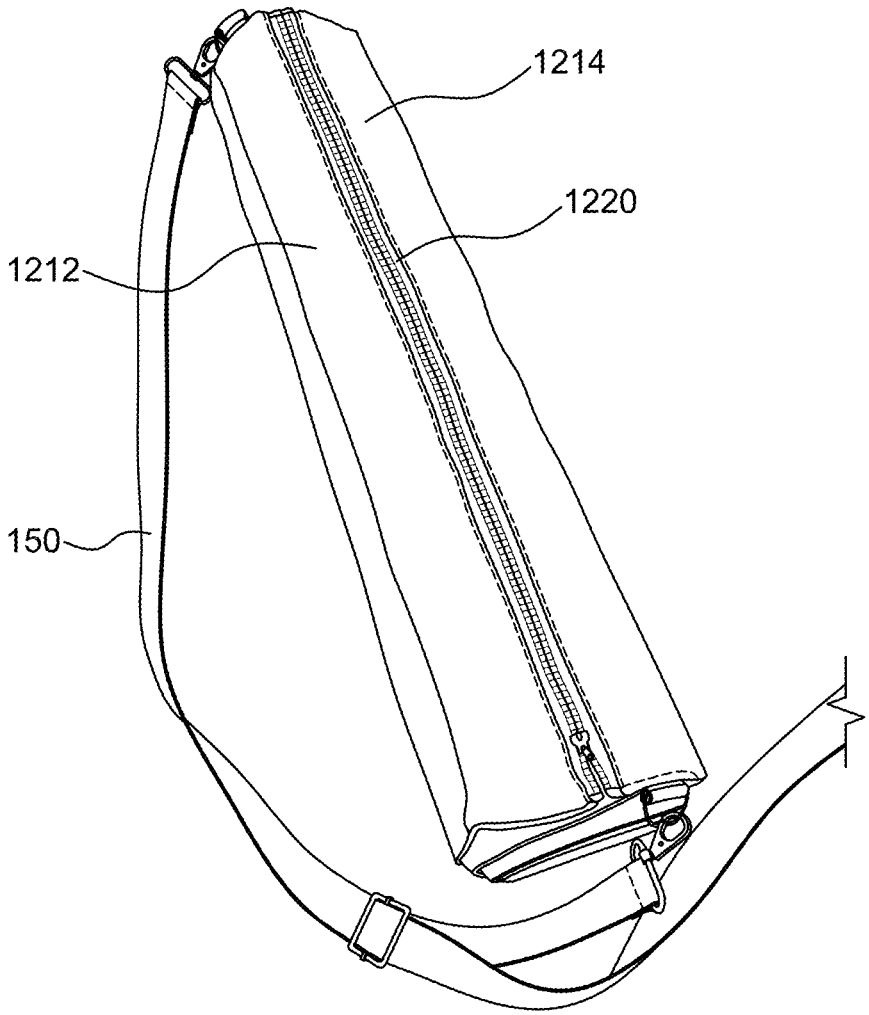
Figure 15:
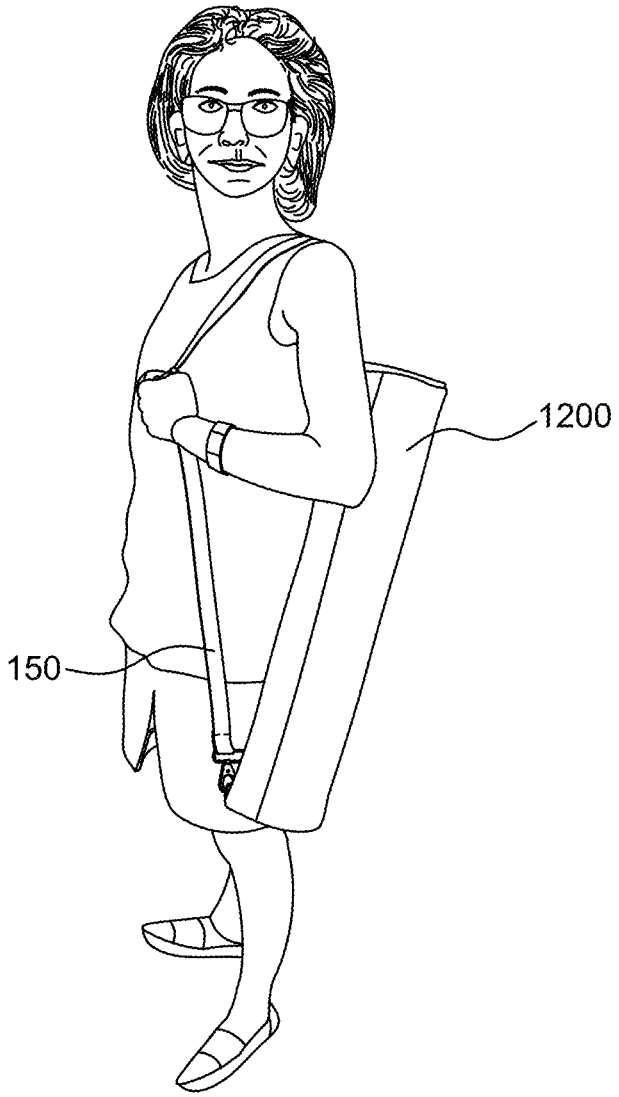
Figure 16:
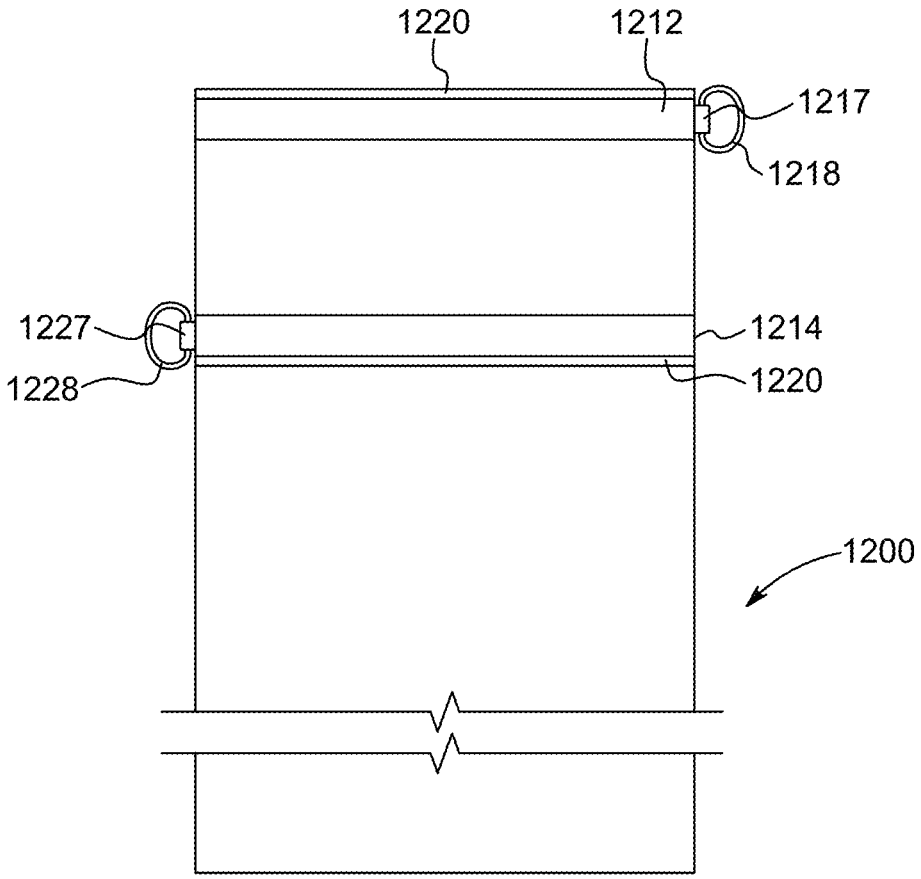
Figure 17:
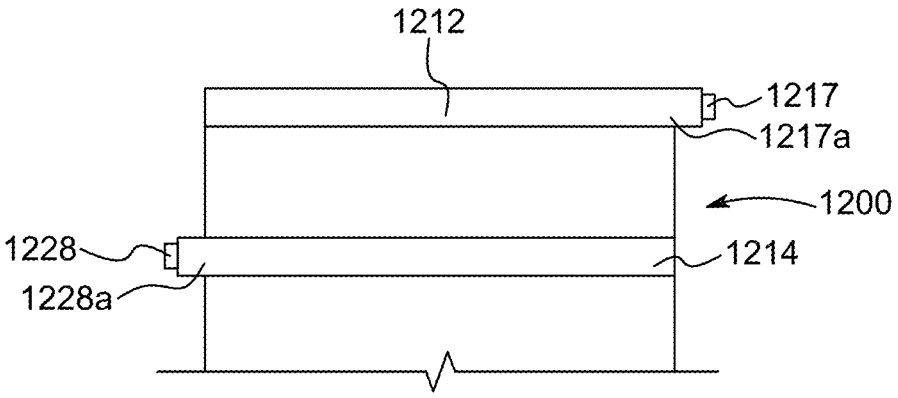

FIG. 11 shows an overview of the yoga mat 100 in an unrolled configuration. In such a configuration, the mat 100 includes a towel 160 attached to the mat 100 via snaps 165. This also shows the top and bottom edge wraps 112,114 and a preferred length of the towel 160 compared to the overall length of the mat 100: 50%-75% the length of the mat 110.

Figure 3:
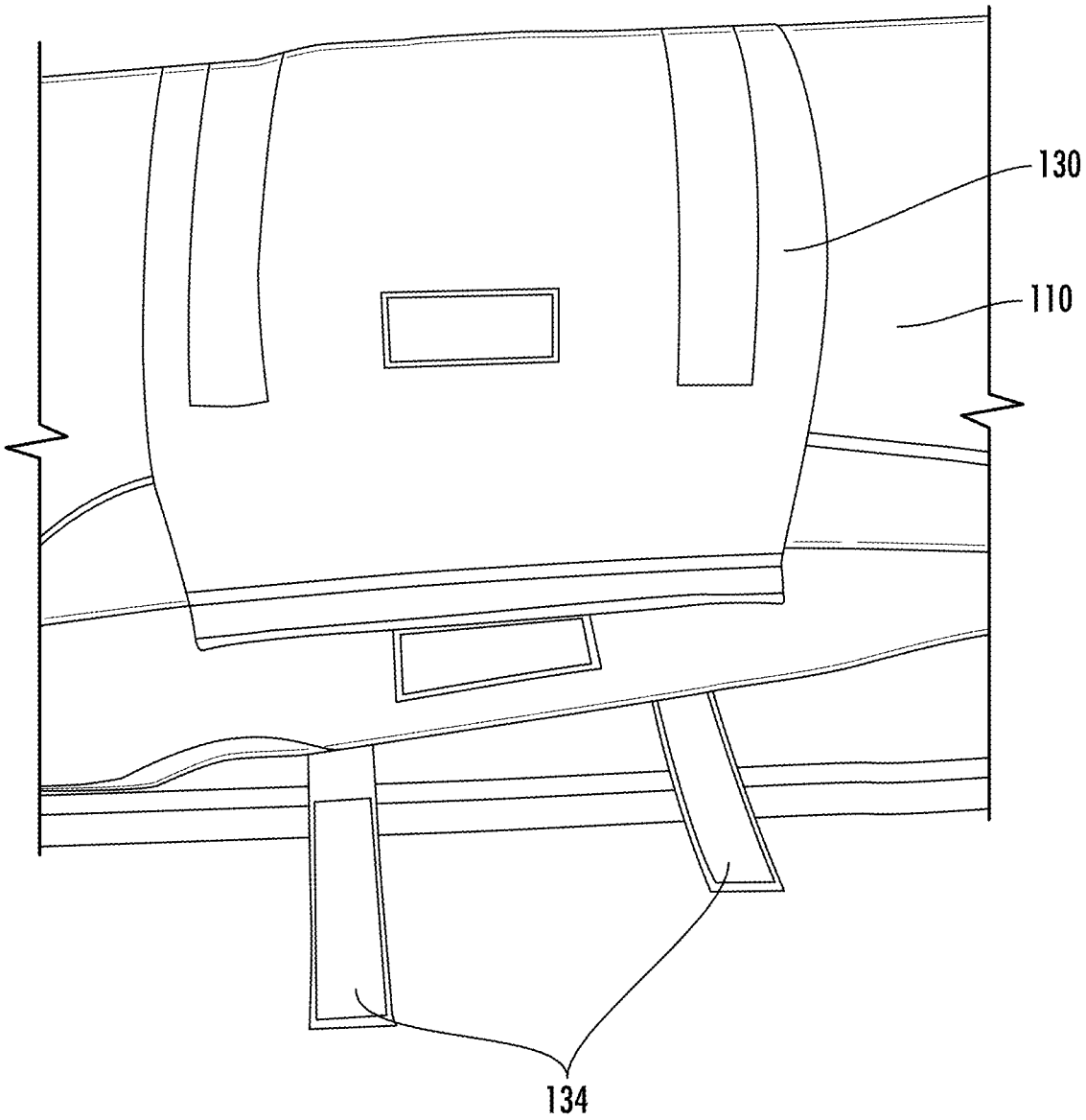
FIGS. 3-5 are detailed views of the mat closure mechanism.
Figure 4:
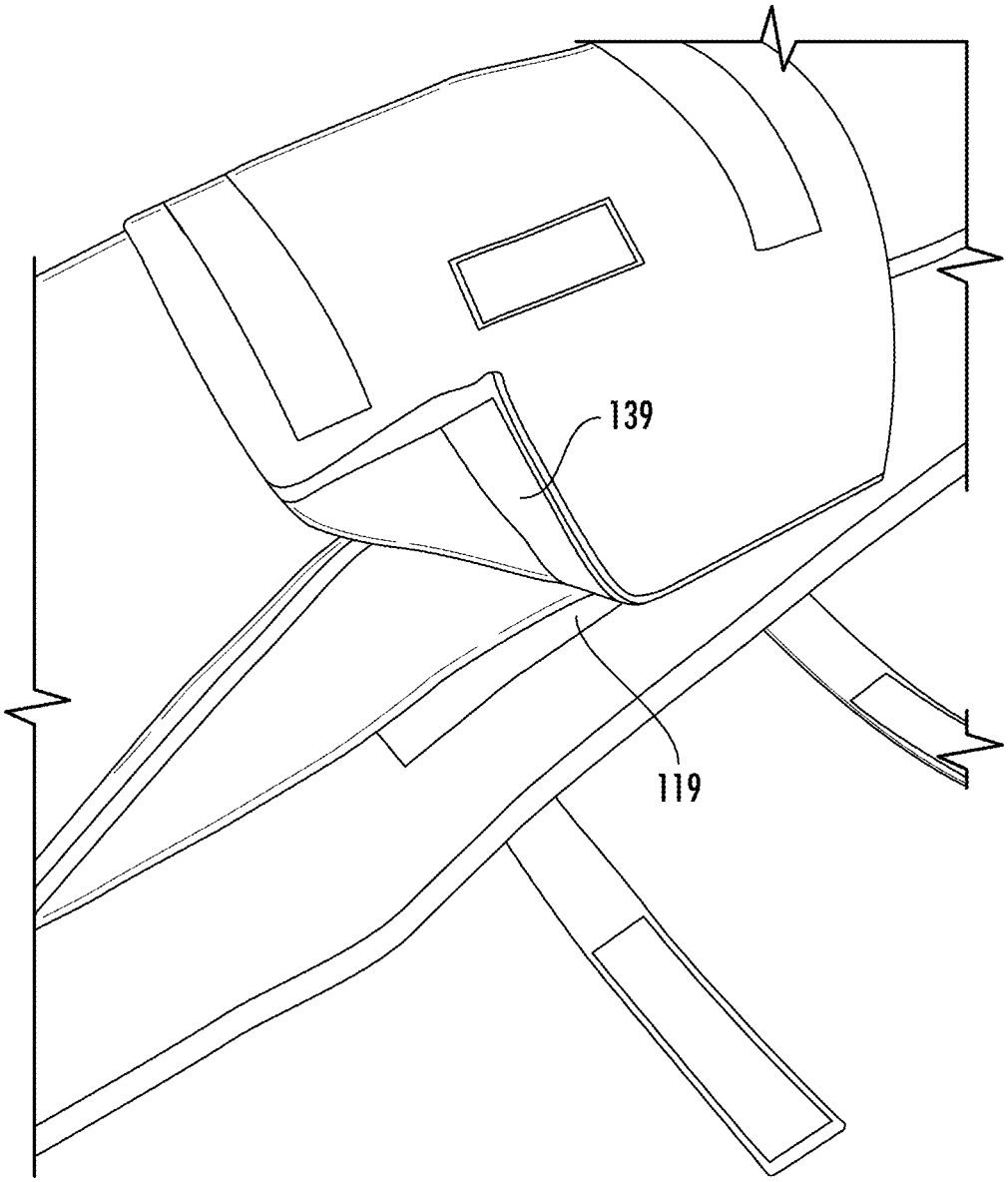
Figure 5:
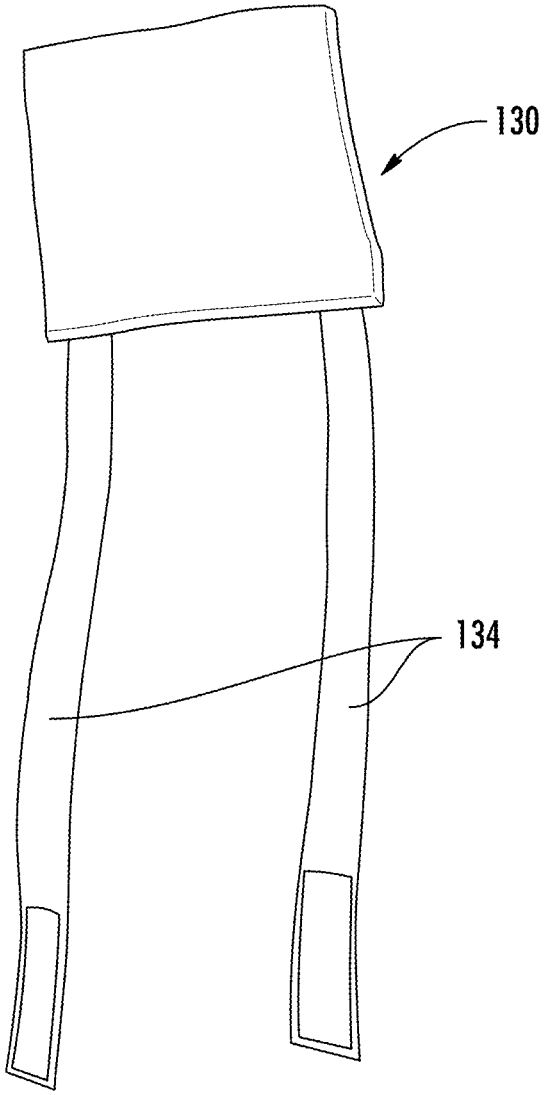

The accessorized mat 100 may include a closure mechanism 130 as shown in FIGS. 3-5 that secures the mat in the rolled configuration. The closure mechanism 130 may include a storage compartment 132 and hook and loop closure straps 134 that secures the mat 110 in the rolled configuration by wrapping around the mat 110. The closure straps 134 may be removable from the closure mechanism 130.

The closure mechanism 130 may removably engage an edge wrap 112, 114 engaged to the mat 110 at a closure mechanism engagement area 139 and mat engagement area 119. As shown, this engagement is a hook and loop engagement to a top side 131 of the mat 110, although it should be understood that the engagement could be to a bottom side 133 of the mat 110. The top side 131 refers to the side of the mat that is inwardly rolled and the bottom side 133 is outwardly facing, as best seen in FIG. 8.

The closure mechanism 130 may include a pocket that can be accessed by a zipper or other sealable means, for storage of money or cell phone. It should also be appreciated that as shown in FIG. 5, the closure mechanism 130 may be separated from the mat 110 and used as a standalone accessory.

The accessorized yoga mat 100 may include an edge wrap 112 that is attached to an edge 111 of the yoga mat 110 and in this case a top edge of the yoga mat 110, where a top edge is usually an edge where a yoga practitioner more normally faces during practice. The edge wrap 112 may be a cleansable fabric or other material for use in an athletic, and particular, a sweat-inducing setting. Such materials may include cotton, microfiber, polyester, etc. An opposing bottom edge wrap 114 is on a bottom edge of the mat 110. The edge wraps 112, 114 serve two purposes, one being to assist in engagement of certain straps and fixtures to the mat 110, as described below, and the other to add some weight and/or stability to the mat 110 such that the mat 110 lies flat in use, since yoga mats often curl up when unrolled.

The accessorized yoga mat 100 may also include a carrying strap 150 removably engaged to the mat 110 and capable of supporting the mat 110 during transport. The carrying strap 150 may be removable from the mat 110 via hook and loop, snap, or ring engagement as shown. The carrying strap 150 can be adjustable length and the carrying strap rings at the ends of the carrying strap 150 may be wrapped inside removable end sleeves to prevent metal-on-metal jingling during transport, or alternatively after removal, the sleeves may also act as handholds while the carrying strap 150 is used during certain movements in yoga practice. As best seen in FIGS. 1 and 8A-8E, the edge wrap 114 wraps around a mat-engaging portion 152 of the carrying strap 150.

As noted, the carrying strap 150 may be engaged to mat 110 through a mat strap 117, and the mat strap 117 is itself attached to the mat 110 and/or the bottom edge wrap 114. The mat strap 117 may be separate from the carrying strap 150 or a single piece therewith, and the mat strap may be attached to the mat 110 or attached to the edge wrap 114, or all three of the mat strap 117, edge wrap 114, and mat 110 may be connected to one another through a common connection 116. The connection between these is preferably though stitching.

Figure 8A:
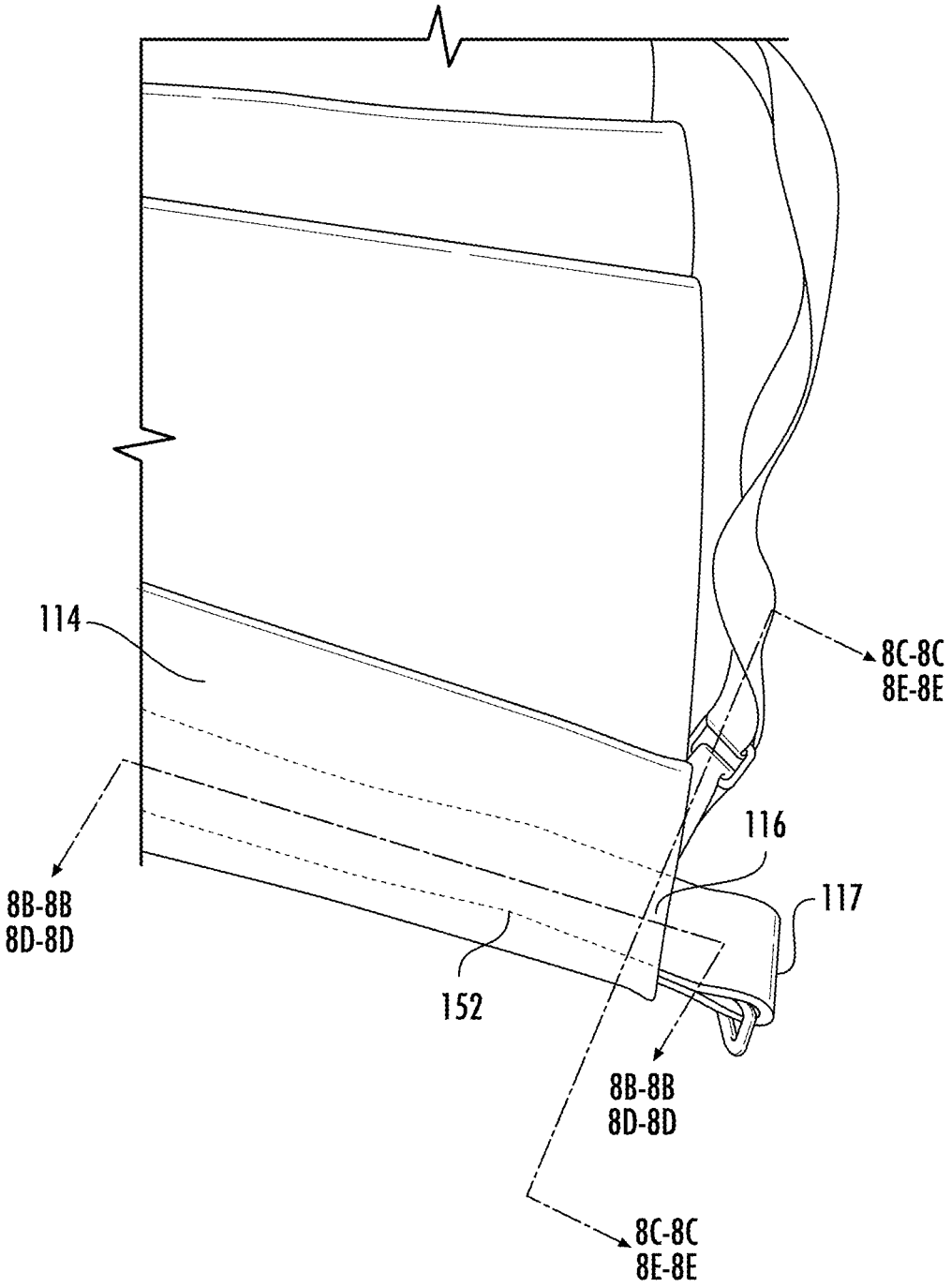
FIGS. 8A-8E, 9 and 10 show details of the edge wrap.
Figure 8B:
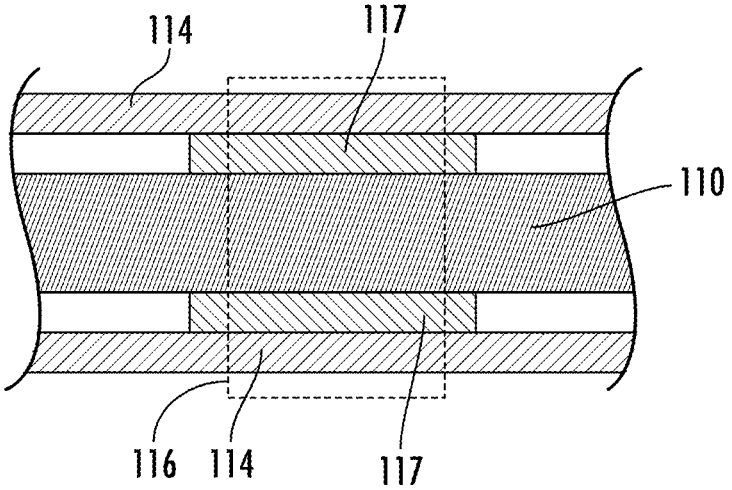
Figure 8C:
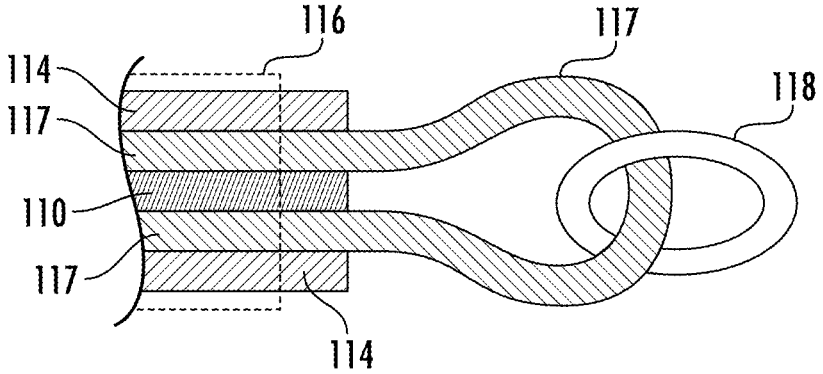
Figure 8D:
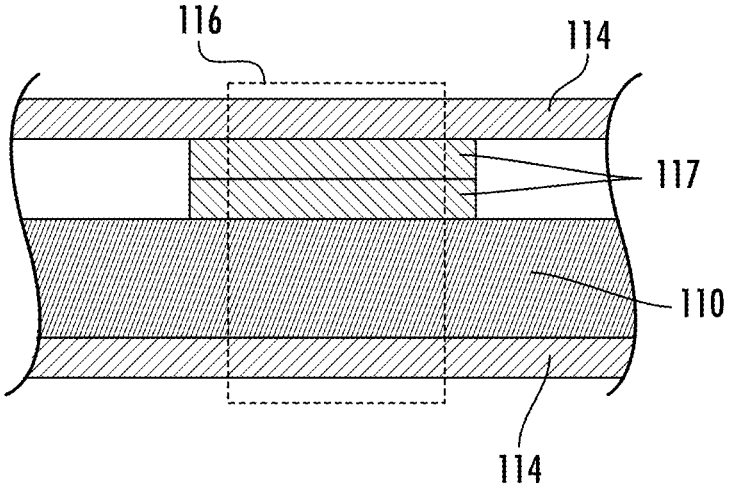
Figure 8E:
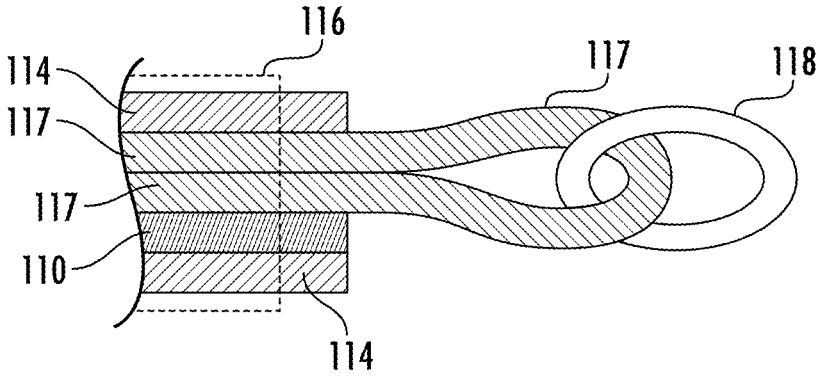

FIGS. 8B-8E show different cross sectional embodiments through 8B-8B, 8C-8C, 8D-8D, and 8E-8E in FIG. 8A In FIGS. 8B and 8D, the mat strap 117 is engaged to either side of the mat 110, which may result in a more secure engagement between the mat strap 117 and the mat given that the common connection 116 could compress the soft mat 110 between layers of the mat strap 117. Alternatively as shown in FIGS. 8C and 8E, the mat strap 117 may be on one or the other side of the mat 110. This may be advantageous to speed production and assembly, and also to present a flatter mat 110 during practice.

Figure 6:
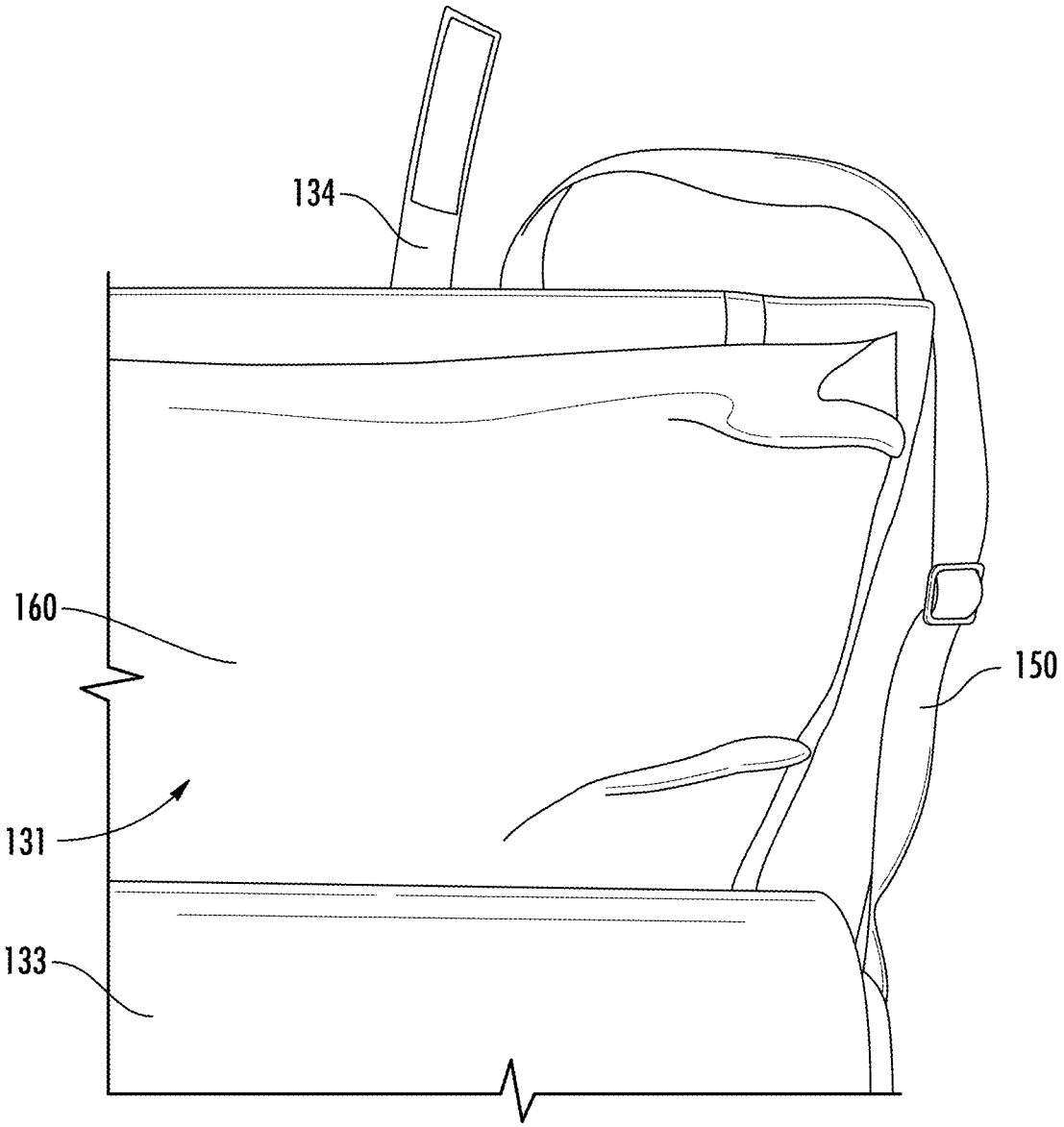
FIGS. 6 and 7 show details of the towel and engagement between the towel and mat.
Figure 7:
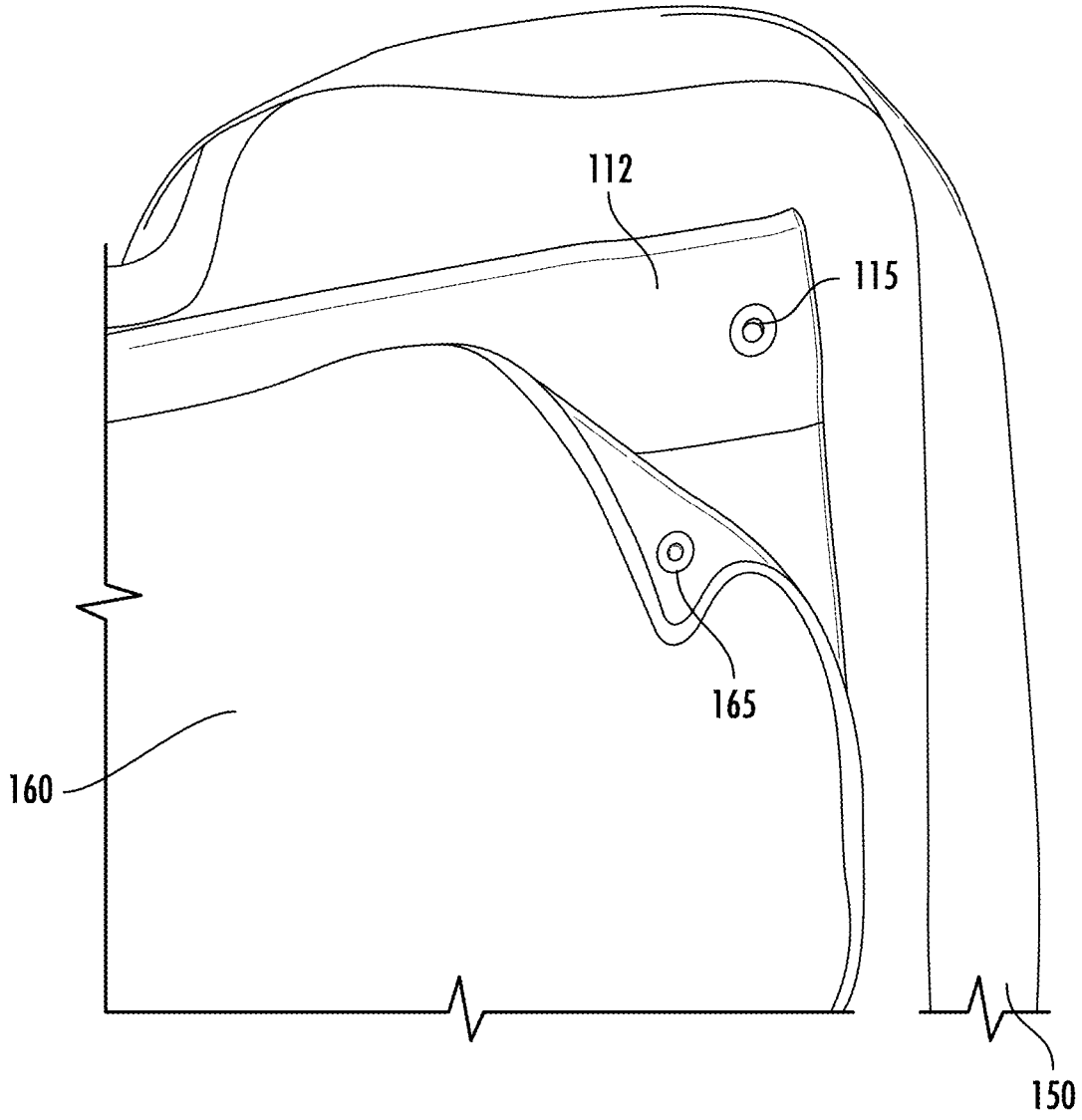
Figure 9:
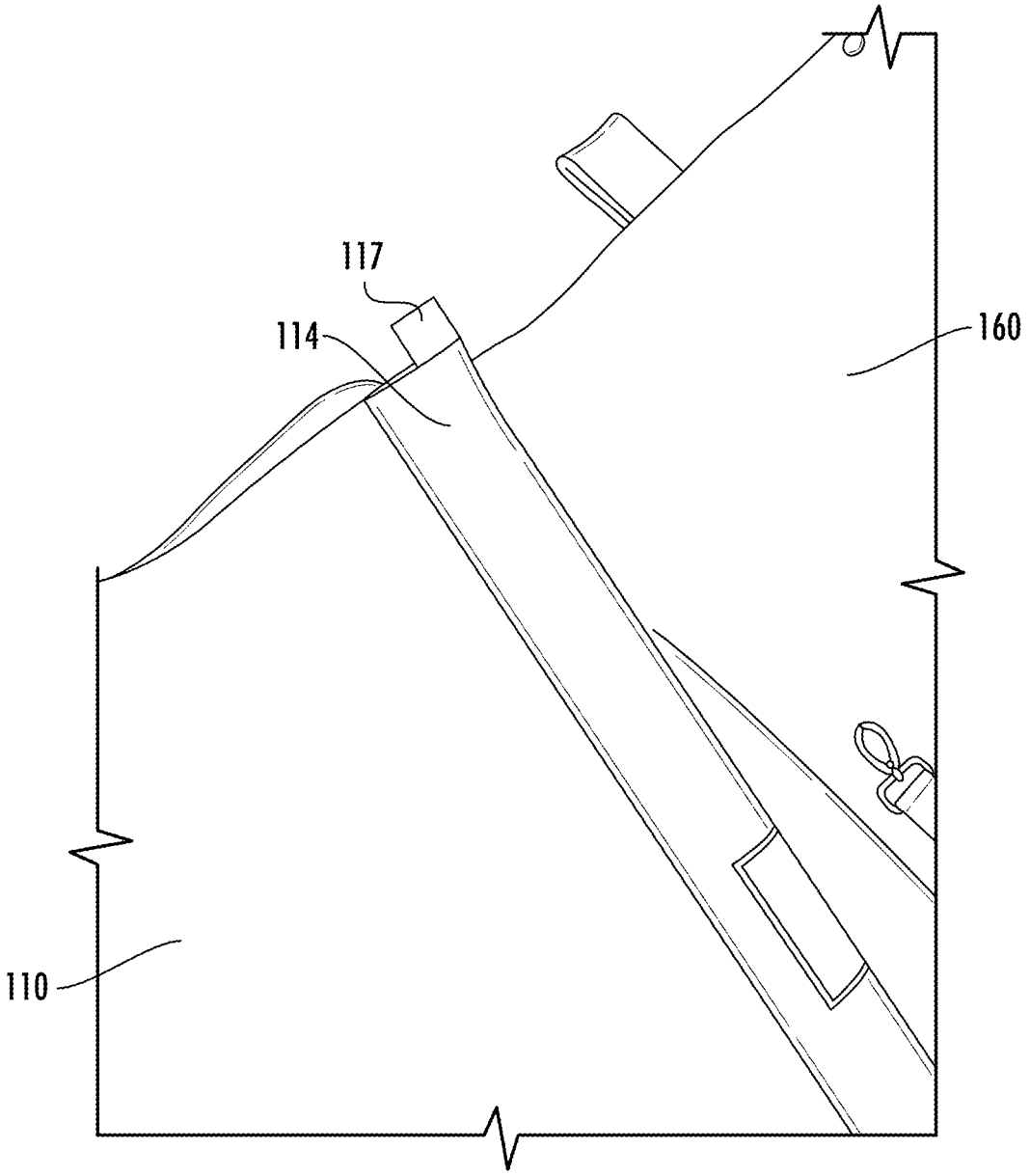
Figure 10:
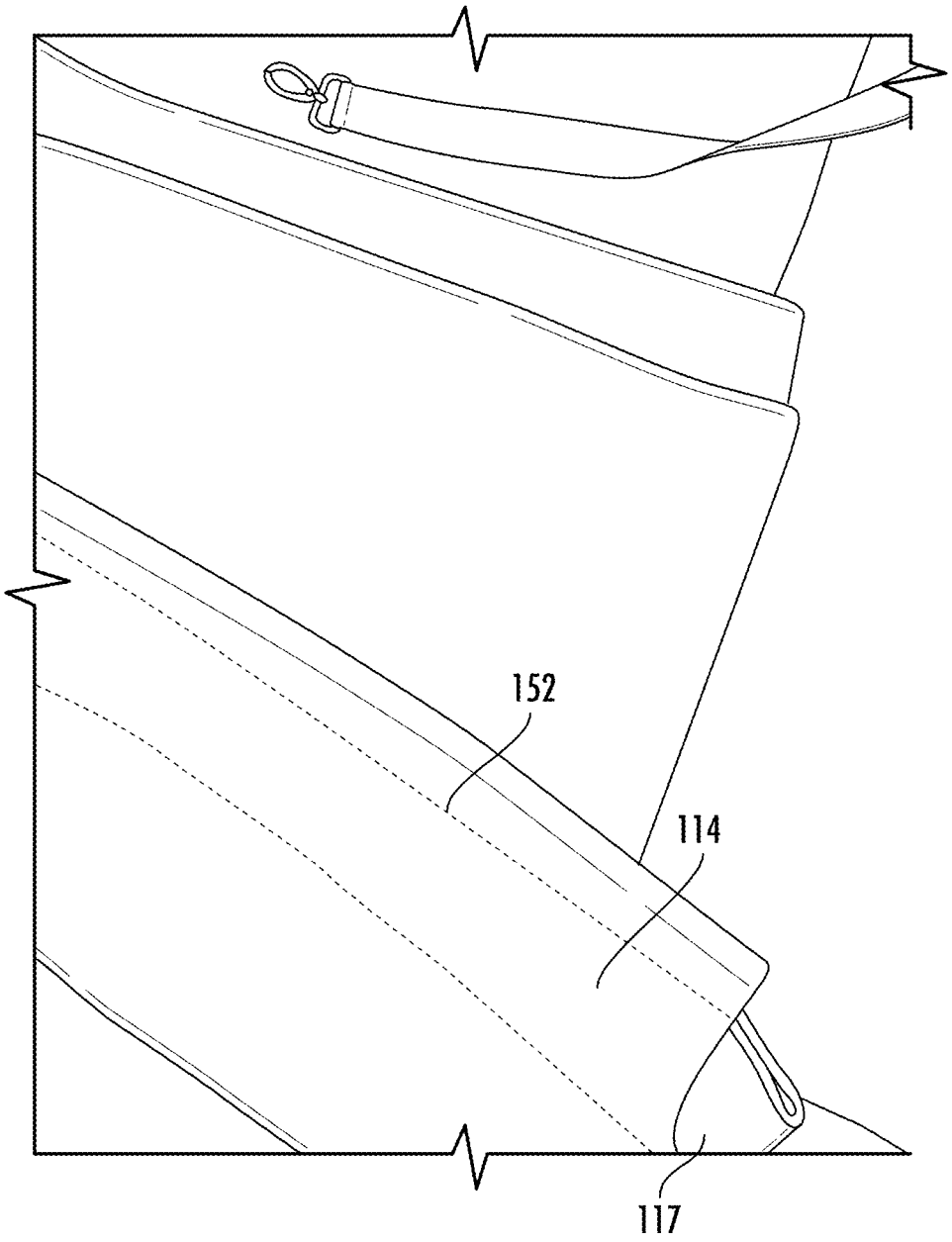

The mat 110 may further include a towel 160 that is detachably attached thereto as best seen in FIGS. 6,7, and 9. The towel 160 may be any washable material that absorbs sweat and moisture that may accumulate during intense sessions. The towel is secured to the mat 110 in order to prevent movement during practice, and the attachment may include snaps located on the towel 165 and mat 115 respectively. The attachment is preferably located along a perimeter of the mat 110.

As shown, the towel is engaged to the top side, top edge of the mat 110 since that is the place where the most sweat will accumulate from the practitioner's head. The towel may extend for the length of the top side 131 of the mat 110, but there is an advantage to the towel only extending from half to 75% of the length of the mat to allow a practitioner's feet to be free to engage the mat 110 and not a towel, which encourages better traction and balance between a practitioner's bare feet and the mat 110.

Figure 2:
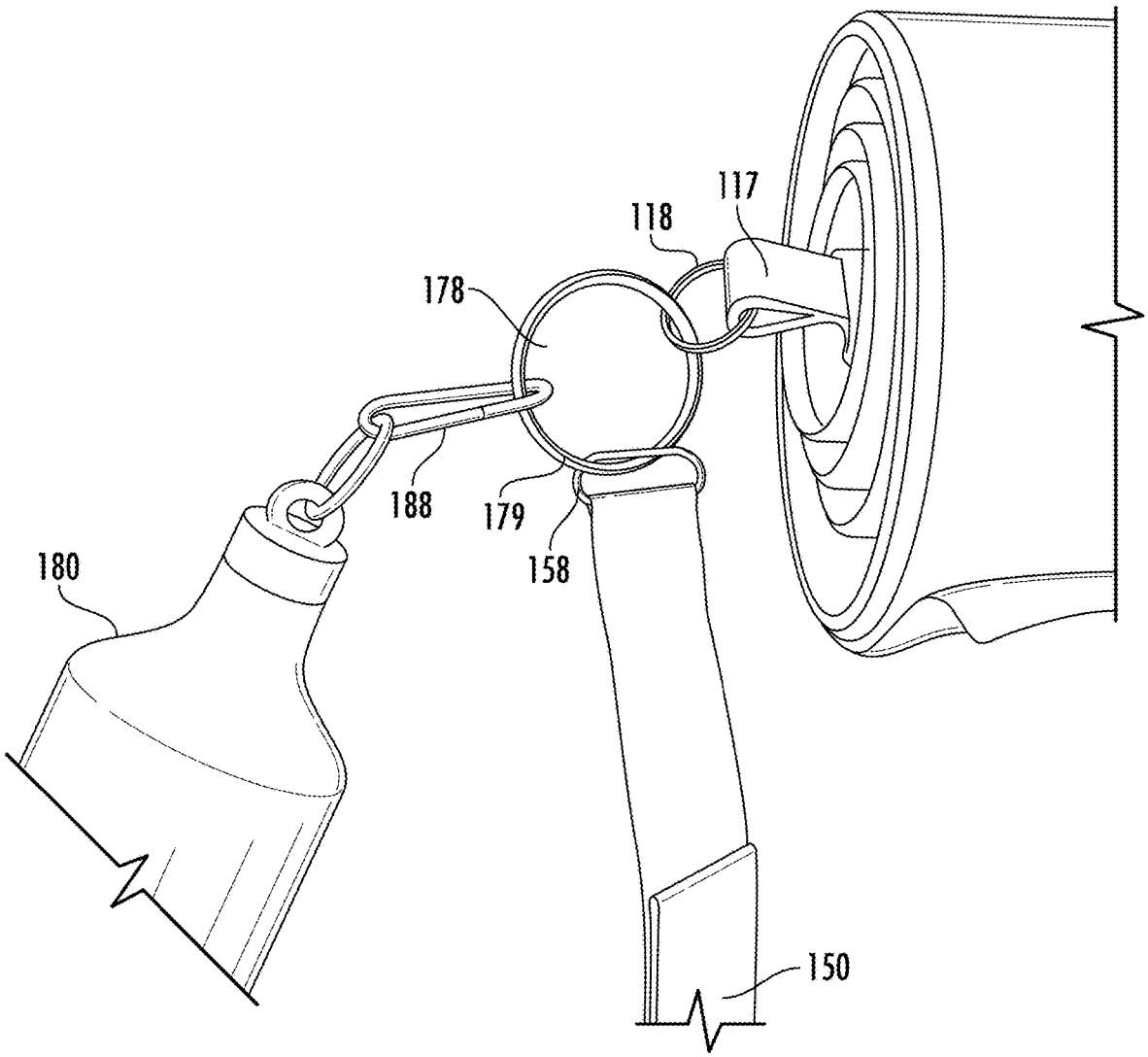
FIG. 2 is a detailed view of the common ring and its engagement to other rings.

As best seen in FIG. 2, the mat strap 117 may include a mat ring 118 that engages a common ring 178. The common ring 178 may have a hinged openable portion 179 similar to a carabiner for engagement to other yoga- or related accessories such as a water bottle 180 having a water bottle ring 188 that can engage the common ring 178, or a strap ring 158 on the strap. Any or all of the rings may be openable like the common ring 178, although only one openable ring is required for multiple accessory engagement.

FIGS. 12-17 show another embodiment of the mat 1200 having an end wrap 1212 at an end of the mat and an intermediate mat wrap 1214 parallel to the end wrap 1214 at a distance therefrom. The wraps 1212, 1214 include engaging teeth of a zipper 1220. In its rolled up storage state, the mat 1200 can be securely closed using the zipper 1220 for easy storage and transport (using an optional strap 150). The mat 1200, of course, can be unrolled for use as an athletic mat, with the wraps 1212, 1214, laying flat during the workout. The intermediate mat wrap 1214 may be spaced from the end wrap 1212 such that when rolling up the mat, zipper teeth on each of the respective zipper portions 1220 on each of the wraps 1212, 1214 align for easy closure.

The end wrap 1212 engages a first mat strap 1217, and the intermediate mat wrap 1214 engages a second mat strap 1227 in the manner discussed previously at least in reference to FIGS. 8A-8E. The mat straps 1217, 1227 may folded on themselves to create loops that engage mat rings 1218, 1228, which can then be engaged to a shoulder strap 150.

Alternatively, the end wrap 1212 and intermediate mat wrap 1214 may be stitched or otherwise directly attached to the mat. The intermediate mat wrap 1214 may be attached on only one side of the mat. A short mat strap 1217, 1227 may only engage the wraps 1212, 1214 and not engage the mat itself at all. The short mat strap 1217, 1227 may engage the wraps 1212, 1214 at wrap tabs 1217*a*. 1227*a* extending therefrom.

While the invention has been described with reference to the embodiments above, a person of ordinary skill in the art would understand that various changes or modifications may be made thereto without departing from the scope of the claims.

I claim:

1. A yoga mat comprising: a rectangular mat including at least two configurations, a rolled configuration, and an unrolled configuration wherein the rectangular mat has a top surface and a bottom surface; a closure mechanism that secures the mat in the rolled configuration, wherein the closure mechanism is a zipper; a first mat strap attached to the rectangular mat at a first mat engaging portion of the first mat strap, the first mat strap being folded against itself on the first mat engaging portion to form a first mat strap loop, wherein the first mat strap is located on one of the top surface or the bottom surface of the mat; a second mat strap attached to the rectangular mat at a second mat engaging portion of the second mat strap, the second mat strap being folded against itself on the second mat engaging portion to form a second mat strap loop, wherein the second mat strap is located on one of the top surface or the bottom surface of the mat; an edge wrap attached to one of a top or bottom shorter edges of the rectangular mat, wherein the edge wrap wraps around the first mat engaging portion and the rectangular mat, wherein half of the zipper is directly engaged to the edge wrap; an intermediate mat wrap spaced apart from both of the top and bottom shorter edges of the rectangular mat and the edge wrap and parallel thereto, wherein the intermediate mat wrap wraps around the second mat engaging portion and the rectangular mat, wherein half of the zipper is directly engaged to the intermediate wrap; and a carrying strap removably engaged to the first mat strap loop and second mat strap loop, and capable of supporting the mat during transport; wherein in the closed configuration, the zipper halves are engaged to one another.

2. The yoga mat of claim 1, further comprising a towel detachably engaged to a top side of the rectangular mat.

3. The yoga mat of claim 2, wherein the detachable engagement between the towel and the mat is accomplished through a snap.

4. The yoga mat of claim 1, wherein the first mat strap and second mat strap include mat rings, wherein the carrying strap has two strap engaging rings that engage the mat rings.

5. The yoga mat of claim 4, further comprising a water bottle having a bottle engaging ring that engages either of the mat ring or strap engaging ring.

6. The yoga mat of claim 5, further comprising a common ring having an openable portion, the common ring being engageable through the opening portion to the carrying strap and mat strap.

7. A yoga mat comprising: a rectangular mat including at least two configurations, a rolled configuration, and an unrolled configuration wherein the rectangular mat has a top surface and a bottom surface; a closure mechanism that secures the mat in the rolled configuration, wherein the closure mechanism is a zipper; a first mat strap folded against itself to form a first mat strap loop, wherein the first mat strap is located on one of the top surface or the bottom surface of the mat; a second mat strap folded against itself to form a second mat strap loop, wherein the second mat strap is located on one of the top surface or the bottom surface of the mat; an edge wrap attached to one of a top or bottom shorter edges of the rectangular mat, wherein the edge wrap engages the rectangular mat and includes a tab to the first mat strap, wherein half of the zipper is directly engaged to the edge wrap; an intermediate mat wrap spaced apart from both of the top and bottom shorter edges of the rectangular mat and the edge wrap and parallel thereto, wherein the intermediate mat wrap engages the rectangular mat, wherein the edge wrap engages the rectangular mat and includes a tab engaged to the first mat strap, wherein half of the zipper is directly engaged to the intermediate wrap; and a carrying strap removably engaged to the first mat strap loop and second mat strap loop, and capable of supporting the mat during transport; wherein in the closed configuration, the zipper halves are engaged to one another.

8. The yoga mat of claim 7, further comprising a towel detachably engaged to a top side of the rectangular mat.

9. The yoga mat of claim 8, wherein the detachable engagement between the towel and the mat is accomplished through a snap.

10. The yoga mat of claim 7, wherein the first mat strap and second mat strap include mat rings, wherein the carrying strap has two strap engaging rings that engage the mat rings.

11. The yoga mat of claim 10, further comprising a water bottle having a bottle engaging ring that engages one of the mat ring or one of the two strap engaging rings.

12. The yoga mat of claim 11, further comprising a common ring having an openable portion, the common ring being engageable through the opening portion to the carrying strap and mat strap.

* * * * *